US006344849B1

(12) United States Patent
Ohashi

(10) Patent No.: US 6,344,849 B1
(45) Date of Patent: Feb. 5, 2002

(54) DISPLAY CONTROL CIRCUIT SUITABLE FOR MULTI-SCREEN DISPLAY

(75) Inventor: Katsuhisa Ohashi, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/201,164

(22) Filed: Nov. 30, 1998

(30) Foreign Application Priority Data

Nov. 28, 1997 (JP) ..... 9-341987

(51) Int. Cl.[7] ..... G09G 5/00
(52) U.S. Cl. ..... 345/204; 345/560
(58) Field of Search ..... 345/507, 196, 345/513, 197, 198, 536, 537, 541, 560, 112, 113, 114, 115, 204, 211, 212, 213; 348/581

(56) References Cited

U.S. PATENT DOCUMENTS

| | | | | |
|---|---|---|---|---|
| 4,868,557 A | * | 9/1989 | Perlman | 345/201 |
| 5,265,234 A | | 11/1993 | Ogura et al. | |
| 5,469,223 A | * | 11/1995 | Kimura | 348/581 |
| 5,523,973 A | | 6/1996 | Kimura et al. | |
| 5,767,864 A | | 6/1998 | Kimura et al. | |

FOREIGN PATENT DOCUMENTS

| | | |
|---|---|---|
| JP | 8123402 | 5/1996 |
| JP | 8-289138 | 11/1996 |

* cited by examiner

*Primary Examiner*—Xiao Wu
(74) *Attorney, Agent, or Firm*—Foley & Lardner

(57) ABSTRACT

The present invention provides a display control circuit comprising: a single transmission-control/priority-control circuit having a single output and two inputs, one of which receives a sequentially supplied screen data set, and the single transmission-control/priority-control circuit being capable of transmission-control and priority-control of the sequentially supplied screen data; and a single line buffer having a single input connected to the single output of the single transmission-control/priority-control circuit and two outputs, one of which is connected to other of the two inputs of the single transmission-control/priority-control circuit for sequentially supplying stored data into the other input of the single transmission-control/priority-control circuit every when new data are supplied from the single transmission-control/priority-control circuit so that the processes are continued sequentially until all data relating to all screens have been processed or the currently supplied data to be stored into the line buffer have most significant priority for subsequent read out the stored data as real screen data from the line buffer.

3 Claims, 5 Drawing Sheets

DISPLAY CONTROL CIRCUIT SUITABLE FOR MULTI-SCREEN DISPLAY

BACKGROUND OF THE INVENTION

The present invention relates to a display control circuit, and more particularly to a display control circuit suitable for a multi-screen display Multi-screen displays have been used for various systems such as car navigation systems. Differently from a display control circuit for personal computer display, the display control circuit for multi-screen display is required to have a capability of controlling parallel transfers of multiple screen data separately. The display control circuit for multi-screen display will hereinafter be referred to as "display control circuit".

FIG. 1 is a block diagram illustrative of a conventional display control system for controlling a multi-screen display. The conventional display control system comprises a display memory 1, a display control circuit 2 and a monitor 3. The conventional display control system is to display n-number screens. The display memory 1 has first to nth screen data memory spaces 7, 6, 5, - - - 4. The first screen data memory space 7 stores first screen data 1. The second screen data memory space 6 stores second screen data 2. The third screen data memory space 5 stores third screen data. The nth screen data memory space 4 stores nth screen data. A first screen data signal al is fetched from the first screen data memory space 7. A second screen data signal a2 is fetched from the second screen data memory space 6. A third screen data signal a3 is fetched from the third screen data memory space 5. A nth screen data signal an is fetched from the nth screen data memory space 4. A signal b is transmitted from the display memory 1 to the display control circuit 2. The display control circuit 2 has n-number line buffers 11, 10, 9, and 8 and a transmission-control/priority-control circuit 12. A first line buffer 11 receives a first line buffer write signal c1. A second line buffer 10 receives a second line buffer write signal c2. A third line buffer 9 receives a third line buffer write signal c3. A nth line buffer 8 receives a nth line buffer write signal c4. The transmission-control/priority-control circuit 12 is connected to the line buffers 11, 10, 9, and 8 so as to fetch first to nth line buffer read out signals e1 - - - en from the first to nth line buffers 11, 10, 9, and 8. The transmission-control/priority-control circuit 12 is capable of performing both a transmission-control which changes priorities of plural screen data and a priority-control which select higher one of the plural screen data. A final data signal f is transmitted from the transmission-control/priority-control circuit 12 to the monitor 3.

FIG. 2 is a timing chart illustrative of plural screen data signal transmissions of the display control circuit of FIG. 1. The description is directed to transmissions of screen data from the display memory 1 to the line buffers 11, 10, 9, and 8 of the display control screen. First screen data d10, d11, d12 and d13 are read out from the first screen data memory space 7 of the display memory 1 and then transferred as the first screen data signal a1, the signal b and the first line buffer write signal c1 to the first line buffer 11 in the display control circuit 2. Subsequently, second screen data d20, d21, d22 and d23 are read out from the second screen data memory space 6 of the display memory 1 and then transferred as the second screen data signal a2, the signal b and the second line buffer write signal c2 to the second line buffer 10 in the display control circuit 2. Subsequently, third screen data d30, d31, d32 and d33 are read out from the third screen data memory space 5 of the display memory 1 and then transferred as the third screen data signal a3, the signal b and the third line buffer write signal c3 to the third line buffer 9 in the display control circuit 2. Subsequently, nth screen data dn0, da1, dn2 and dn3 are read out from the nth screen data memory space 4 of the display memory 1 and then transferred as the nth screen data signal an, the signal b and the nth line buffer write signal cn to the nth line buffer 8 in the display control circuit 2.

Subsequently, data e1 to en arc concurrently read out and transmitted into the transmission-control/priority-control circuit 12 for conducting transmission-control and priority-control of the data e1 to en, thereby selecting one of the data e1 to en to put out the selected one of the data e1 to en as a data set f of selected data (dx0, dx1, dx2 and dx3) to the monitor.

The above conventional display control system has the following disadvantages. It is required for the above prior art to provide the same number of line buffers as the number of kinds of the screen data. The line buffers has a relatively large ratio in occupied area to the display control circuit 2, for which reason a large increase in the number of kinds of the screen data results in a large increase in the size of the display control circuit 2. This further increases in a cost of the display control system.

Further, during no transmission of screen data from the display memory 1 to the display control circuit 2, other processings are executed such as access from CPU to the display memory and access from a drawing control circuit to the display memory. Shortening the necessary time for transmission of the screen data from the display memory 1 to the display control circuit 2 allows an increase in time for other processings to improve high speed performances of the display system.

It is, however, difficult for the conventional display system to shorten the necessary time for transmission of the screen data from the display memory 1 to the display control circuit 2 for the following grounds. All of the screen data are stored into the plural line buffers before the transmission-control and the priority control are made by the transmission-control/priority-control circuit in the display control circuit, This means that it is possible to determine whether the data priority is highest or not after all of the screen data have already been stored. Namely, in any cases, it is necessarily required for the conventional display system to transmit all of the screen data. This means that increase in the number of kinds of the screen data results in an increase in the necessary transmission time of the signals from the display memory 1 to the display control circuit 2. Namely, it is difficult for the conventional display system to shorten the necessary transmission time of the signals from the display memory 1 to the display control circuit 2.

In the above circumstances, it had been required to develop a novel display control circuit free from the above problems and disadvantages.

SUMMARY OF THE INVENTION

Accordingly, it is an object of the present invention to provide a novel display control circuit free from the above problems.

It is a further object of the present invention to provide a novel display control circuit having a smaller number of line buffers than the number of kinds of screen data for reduction in circuit size.

It is a still further object of the present invention to provide a novel display control circuit capable of conducting transmission-control and priority-control of screen data before the screen data are stored into line buffers so that if screen data to be transmitted have a highest priority, then subsequent data transmission will be omitted in order to shorten the time of transmission of the screen data from the display memory to the line buffers.

The first present invention provides a display control circuit comprising: a data storing unit for storing data; and a comparing and selecting unit connected to the data storing unit for comparing a current priority of a currently supplied data set with a previous priority a previously supplied data set stored in the storing data unit so as to write priority-higher one of the currently supplied data set and the previously supplied data set into the data storing unit, Wherein all of data relating to screens are processed by the comparing and selecting unit to be over-written into the data storing unit and the processes are continued sequentially until all data relating to all screens have been processed or the currently supplied data to be stored into the data storing unit have most significant priority for subsequent read out the stored data as real screen data from the data storing unit.

It is preferable that the data storing unit comprises a single line buffer which is capable of storing data of a single screen and the comparing and selecting unit comprises a single transmission-control/priority-control circuit which is capable of executing both the transmission-control and the priority-control.

It is also preferable that the single transmission-control/priority-control circuit has two inputs, one of which receives the currently supplied data and other receives a sequentially output signal from the single line buffer, and a single output which is connected to an input of the single line buffer for storing and over-writing the data into the single line buffer.

The second present invention provides a display control circuit comprising: a single transmission-control/priority-control circuit having a single output and two inputs, one of which receives a sequentially supplied screen data set, and the single transmission-control/priority-control circuit being capable of transmission-control and priority-control of the sequentially supplied screen data; and a single line buffer having a single input connected to the single output of the single transmission-control/priority-control circuit and two outputs, one of which is connected to other of the two inputs of the single transmission-control/priority-control circuit for sequentially supplying stored data into the other input of the single transmission-control/priority-control circuit every when new data are supplied from the single transmission-control/priority-control circuit so that the processes are continued sequentially until all data relating to all screens have been processed or the currently supplied data to be stored into the line buffer have most significant priority for subsequent read out the stored data as real screen data from the line buffer.

The above and other objects, features and advantages of the present invention will be apparent from the following descriptions.

BRIEF DESCRIPTION OF THE DRAWINGS

Preferred embodiments according to the present invention will be described in detail with reference to the accompanying drawings.

PREFERRED EMBODIMENT

FIRST EMBODIMENT

A first embodiment according to the present invention will be described in detail with reference to FIG. 3 which is a circuit diagram illustrative of a novel display control circuit in a display control system in a first embodiment in accordance with the present invention. The novel display control circuit 2 has a single transmission-control/priority-control circuit 12 and a single line buffer 13. The single transmission-control/priority-control circuit 12 has two inputs which receive screen data "b" from a display memory and a read-out signal "g" form the line buffer 13 for executing the transmission-control and priority-control of the screen data. The single line buffer 13 receives data signals "f" from the single transmission-control/priority-control circuit 12 to store the data signals "f". This operation will repeat until all of the screen data are processed by the transmission-control/priority-control circuit 12. Thereafter, real data are outputted from the single line buffer 13 and then transmitted to a monitor. Every when the transmission-control/priority-control circuit 12 receives the screen data "b" from the display memory, the line buffer 13 outputs the screen data as the signal "g" which is transmitted to the input of the transmission-control/priority-control circuit 12.

Figure 4:
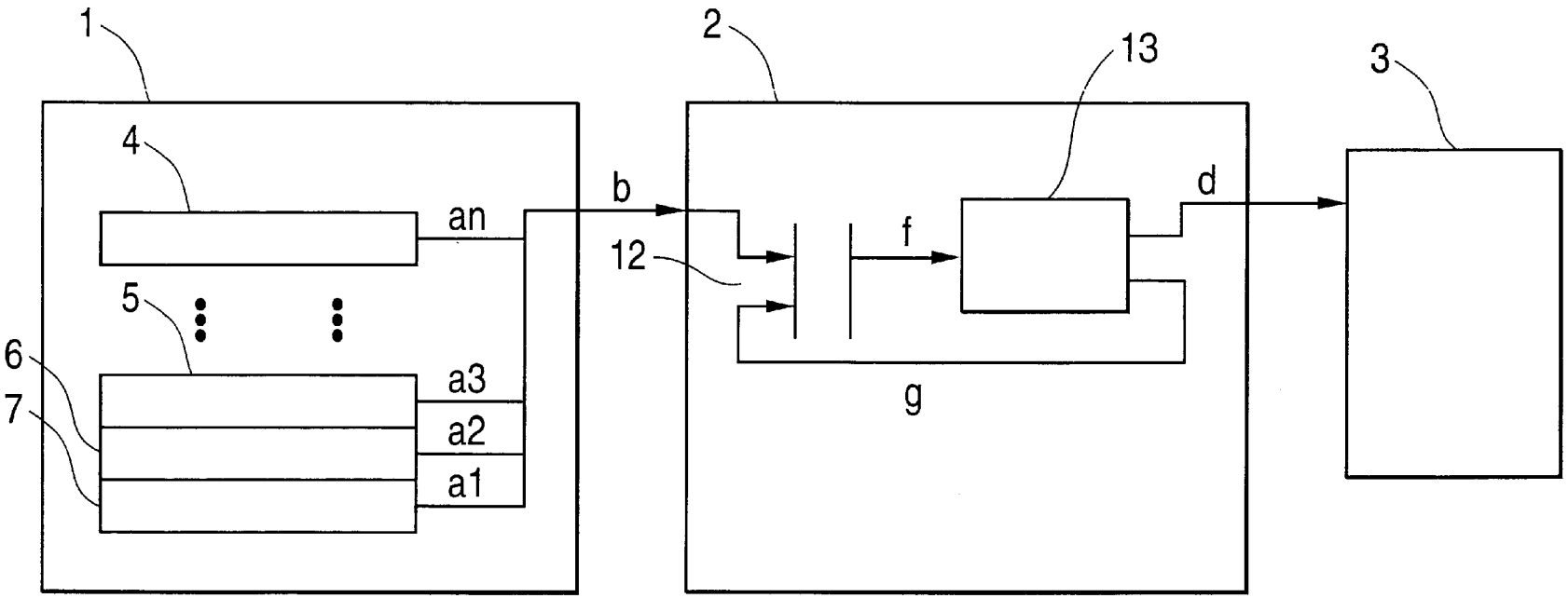
FIG. 4 is a block diagram illustrative of a novel display control system for controlling a multi-screen display in a first embodiment in accordance with the present invention.

The screen data from the display memory are inputted into one of the two inputs of the transmission-control/priority-control circuit 12. The screen data signals "g" stored in the line buffer 13 are transmitted into the other input of the transmission-control/priority-control circuit 12. The transmission-control and the priority-control to the are executed by the screen data "b" and the screen data signals "g" by the transmission-control/priority-control circuit 12. Output screen data "f" are transmitted from the transmission-control/priority-control circuit 12 into the line buffer 13 for storing the output screen data "f" until all of the screen data are processed by the transmission-control/priority-control circuit 12 and then inputted into the single line buffer 13. Therafter, the screen data accumulated in the single line buffer 13 are outputted from the single line buffer 13 in synchronizing with synchronous signals FIG. 4 is a block diagram illustrative of a novel display control system for controlling a multi-screen display in a first embodiment in accordance with the present invention. The novel display control system comprises a display memory 1, a display control circuit 2 and a monitor 3. The novel display control system is to display n-number screens. The display memory 1 has first to nth screen data memory spaces 7, 6, 5, - - - 4. The first screen data memory space 7 stores first screen data 1. The second screen data memory space 6 stores second screen data 2. The third screen data memory space 5 stores third screen data The nth screen data memory space 4 stores nth screen data. A first screen data signal a1 is fetched from the first screen data memory space 7. A second screen data signal a2 is fetched from the second screen data memory space 6. A third screen data signal a3 is fetched from the third screen data memory space 5. A nth screen data signal an is fetched from the nth screen data memory space 4. A signal b is transmitted from the display memory 1 to the display control circuit 2. The novel display control circuit 2 has a single transmission-control/priority-control circuit 12 and a single line buffer 13. The single transmission-control/priority-control circuit 12 has two inputs which receive screen data "b" from the display memory 1 and a read-out signal "g" form the line buffer 13 for executing the transmission-control and priority-control of the screen data. Every when the transmission-control/priority control circuit 12 receives the screen data "b" from the display memory, the line buffer 13 outputs the screen data as the signal "g" which is transmitted to the input of the transmission-control/priority-control circuit 12. The single line buffer 13 receives data signals "f" from the single transmission-control/priority-control circuit 12 to store the data signals "f". This operation will repeat until all of the screen data are processed by the transmission-control/priority-control circuit 12. Thereafter, real data are outputted from the single line buffer 13 and then transmitted to the monitor 3.

Figure 1:
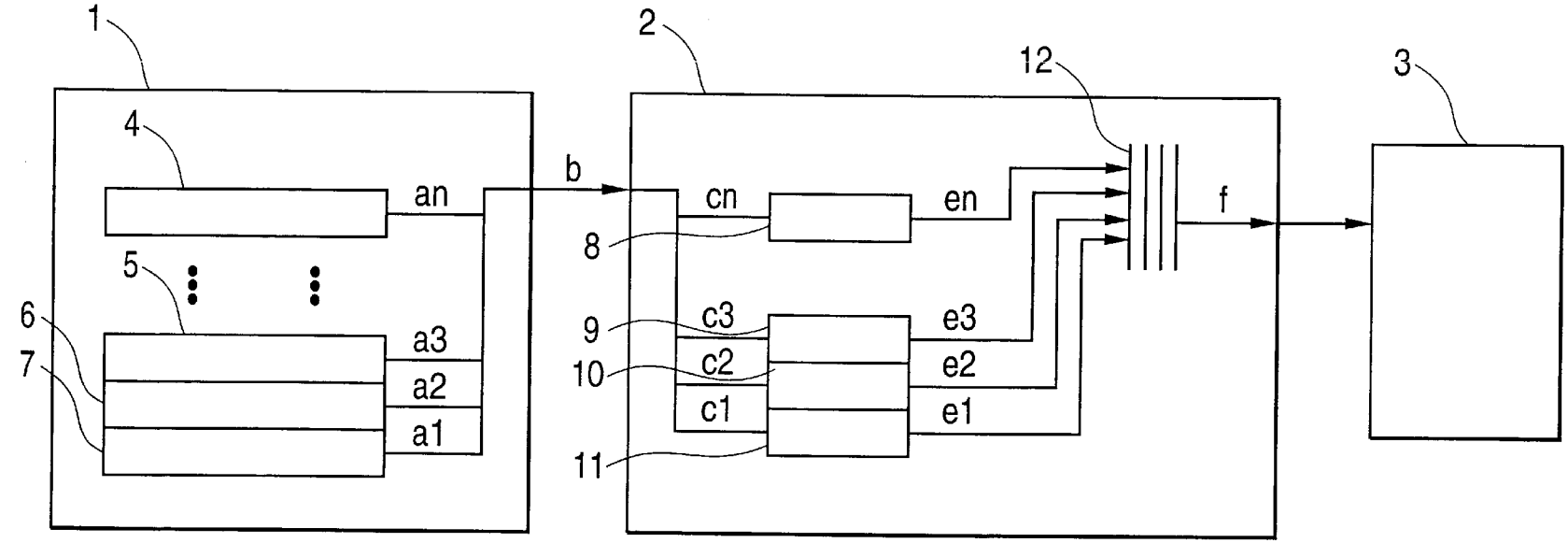
FIG. 1 (PRIOR ART)
FIG. 1 is a block diagram illustrative of a conventional display control system for controlling a multi-screen display.
Figure 2:
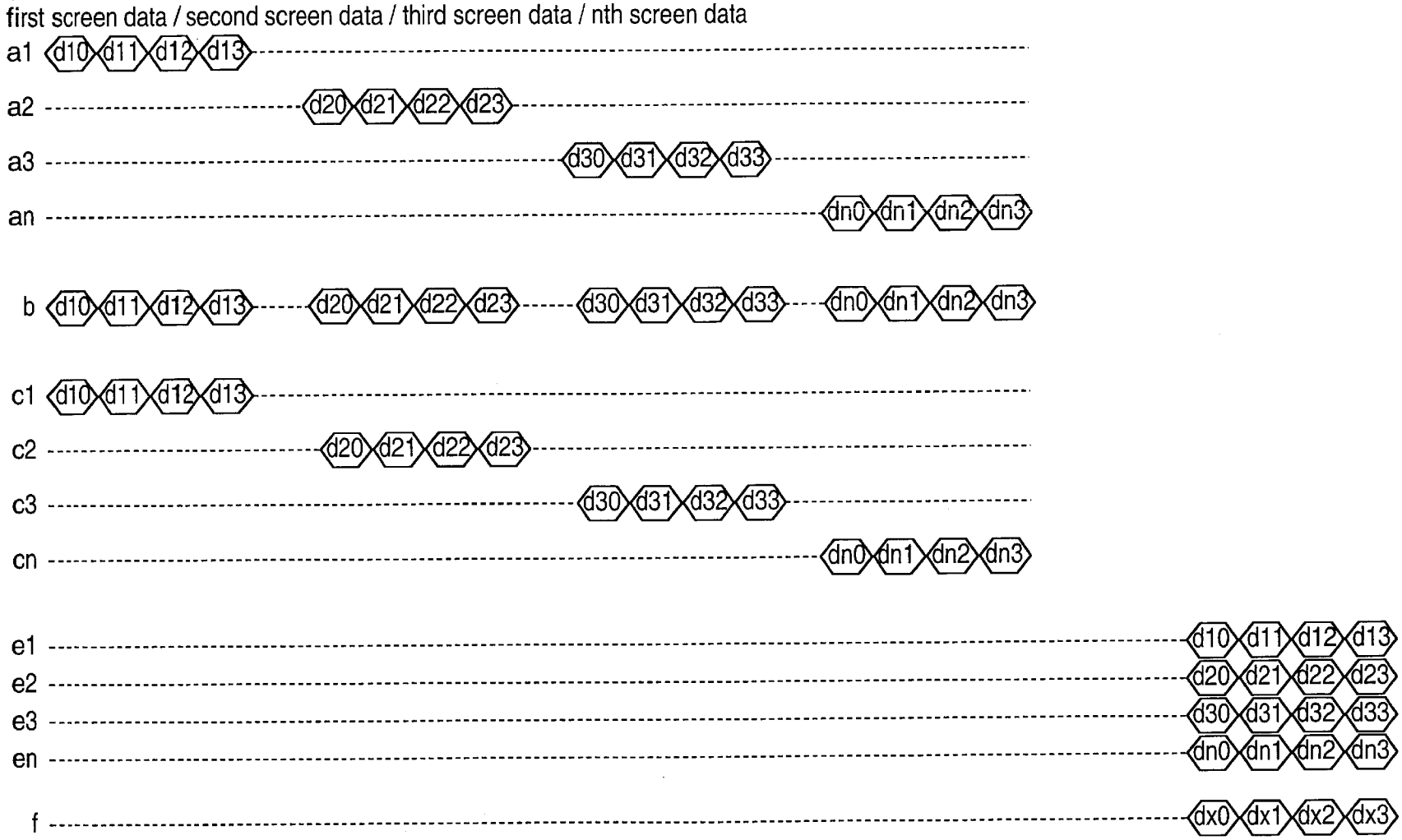
FIG. 2 (PRIOR ART)
FIG. 2 is a timing chart illustrative of plural screen data signal transmissions of the display control circuit of FIG. 1.
Figure 3:
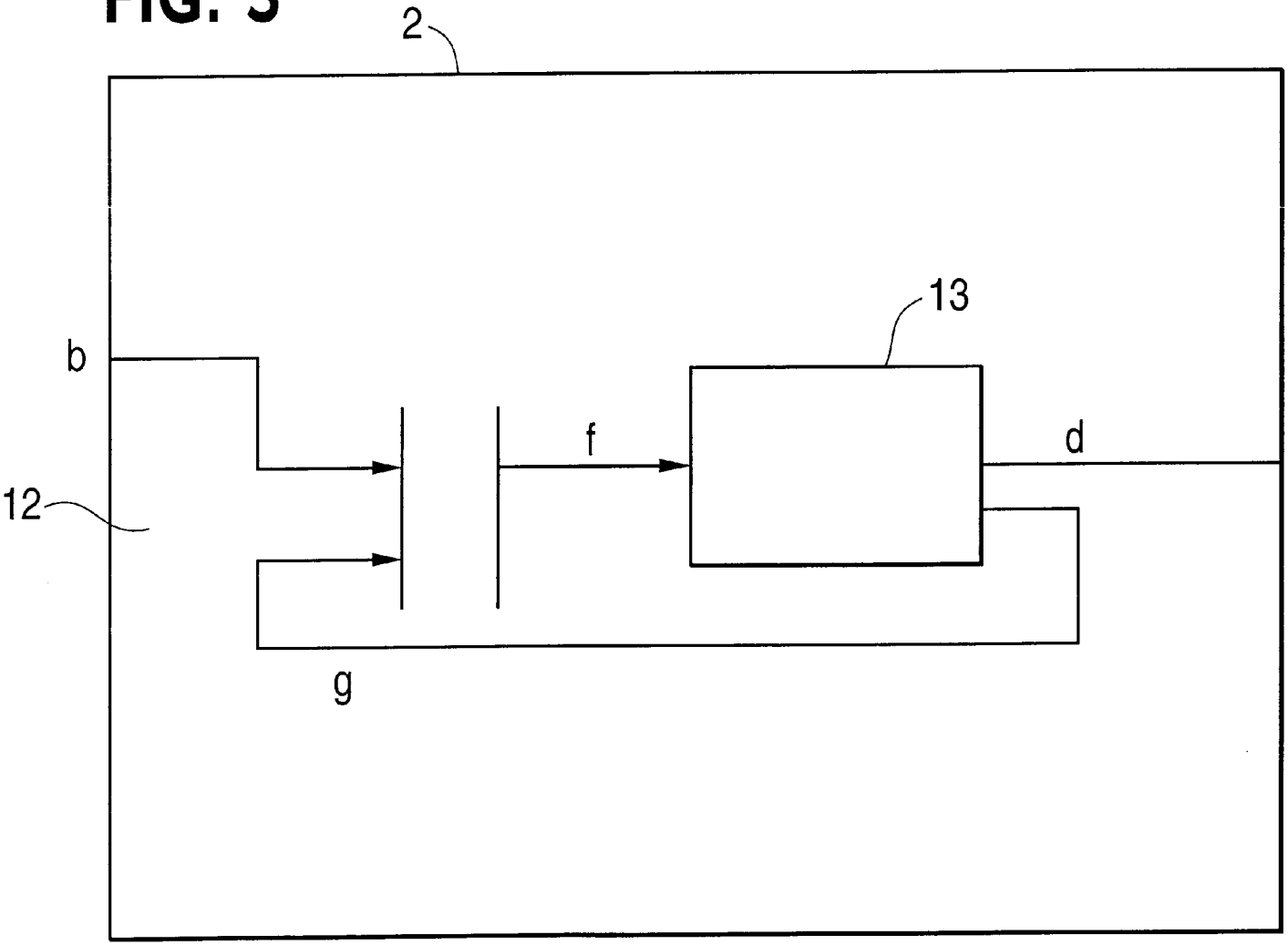
FIG. 3 is a circuit diagram illustrative of a novel display control circuit in a display control system in a first embodiment in accordance with the present invention.
Figure 5:
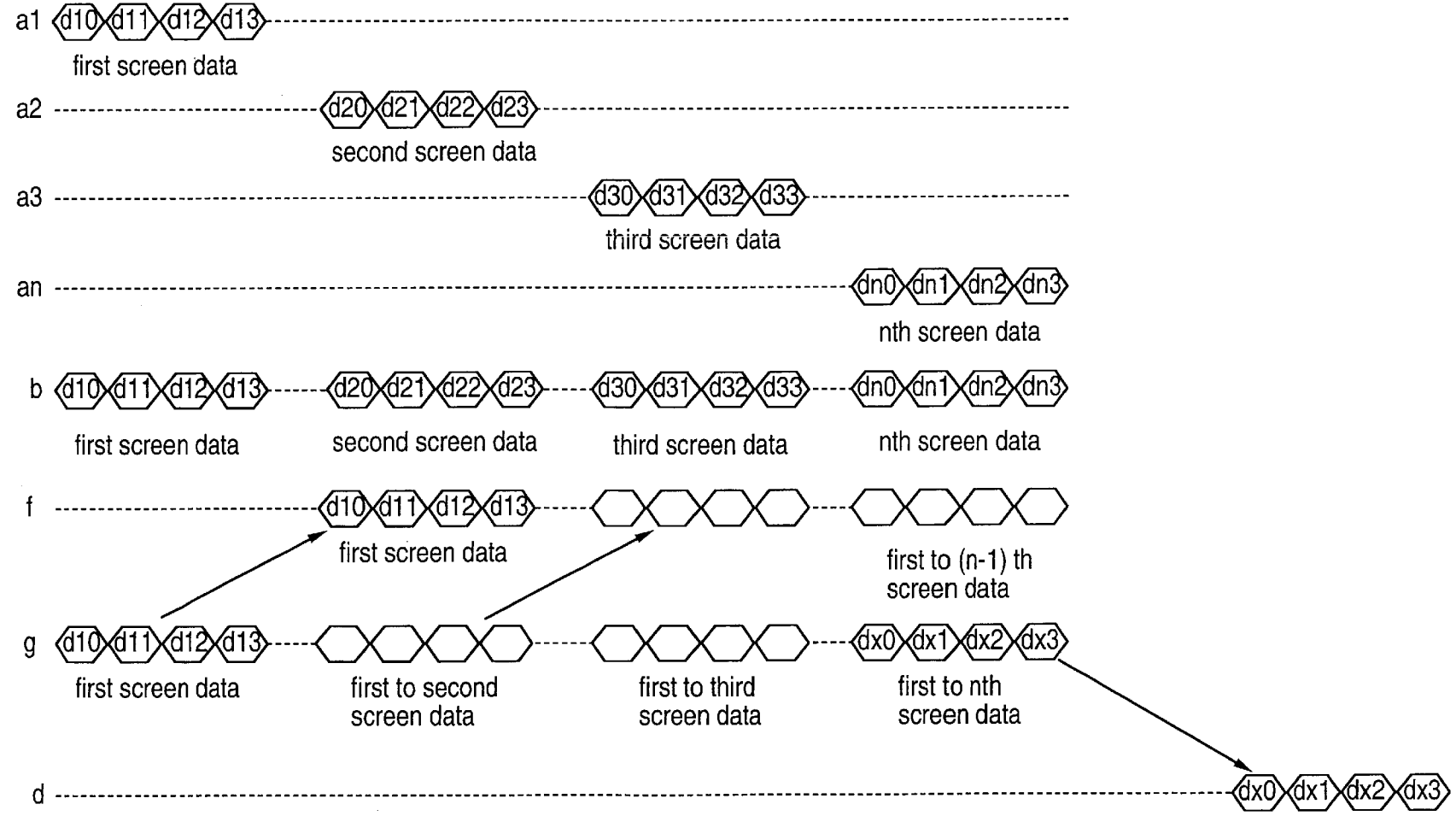
FIG. 5 is a timing chart illustrative of plural screen data signal transmissions of the novel display control circuit of FIG. 3.

FIG. 5 is a timing chart illustrative of plural screen data signal transmissions of the novel display control circuit of FIG. 3. First screen data d10, d11, d12 and d13 are read out from the display memory 1. The first screen data d10, d11, d12 and d13 are transmitted as the signals "all", and the signal "b" into the transmission-control/priority-control circuit 12 of the display control circuit 2. The signal is subjected to the transmission-control and the priority-control by the transmission-control/priority-control circuit 12 and then stored into the single line buffer 13. Subsequently, second screen data d20, d21, d22 and d23 are read out from the display memory 1. The second screen data d20, d21, d22 and d23 are transmitted as the signals "a2", and the signal "b" into the transmission-control/priority-control circuit 12 of the display control circuit 2. Concurrently, the stored first screen data are read out from the single line buffer 13 and transmitted into the input of the transmission-control/priority-control circuit 12 as the signal "g". The signals "b" and "g" are subjected to the transmission-control and the priority-control by the transmission-control/priority-control circuit 12 and then stored into the single line buffer 13. The above processes are repeated until all of the screen data are subjected to the transmission-control and the priority-control by the transmission-control/priority-control circuit 12 and then stored into the single line buffer 13. During the above processes, the signals "f" are sequentially inputted into the single line buffer 13 and then over-written in the single line buffer 13. After the priorities of the data to be stored into the single line buffer 13 become roost significant, then the read out operation from the display memory 1 is discontinued and also the transmission-control and the priority-control are discontinued. After the transmission-control and the priority-control have been finished, then all data dx0, dx1, dx2, dx3 stored in the single line buffer 13 are read out from the single lime buffer 13 to be transmitted into the monitor 3 for display the multi-screens.

In accordance with the present invention, the transmission-control and the priority-control have been made before the data are written into the single line buffer so that the single line buffer is sufficient for obtaining the read screen data. Namely, it is possible to reduce the number of the line buffers into the single.

Further, since the transmission-control and the priority-control have been made before the data arc written into the single line buffer, if the data to be stored into the single line buffer has a highest or most significant priority, then it is unnecessary to transfer subsequent data from the display memory to the display control circuit, thereby shortening the necessary data transfer time. For example, if the first screen data have the most significant priority, then the necessary data transfer time is shortened by one nth.

Whereas modifications of the present invention will be apparent to a person having ordinary skill in the art, to which the invention pertains, it is to be understood that embodiments as shown and described by way of illustrations are by no means intended to be considered in a limiting sense. Accordingly, it is to be intended to cover by claims all modifications which fall within the spirit and scope of the present invention.

What is claimed is:

1. A display control circuit comprising:

means for storing data; and means connected to said data storing means for comparing a current priority of a currently supplied data set with a previous priority a previously supplied data set stored in said data storing means so as to write priority-higher one of said currently supplied data set and said previously supplied data set into said data storing means, wherein all of data relating to screens are processed by said comparing means to be over-written into said data storing means and said processes are continued sequentially until all data relating to all screens have been processed or said currently supplied data to be stored into said data storing means have most significant priority for subsequent read out said stored data as real screen data from said data storing means; and wherein said data storing means comprises a single line buffer which is capable of storing data of a single screen and said comparing means comprises a single transmission-control priority-control circuit which is capable of executing both the transmission-control and the priority-control.

2. The display control circuit as claimed in claim 1, wherein said single transmission-control/priority control circuit has two inputs, one of which receives said currently supplied data and other receives a sequentially output single line buffer, and a single output which is connected to an input of said single line buffer for storing and over-writing said data into said single line buffer.

3. A display control circuit comprising:

a single transmission-control/priority-control circuit having a single output and two inputs, one of which receives a sequentially supplied screen data set, and said single transmission-control/priority-control circuit being capable of transmission-control and priority-control of said sequentially supplied screen data; and a single line buffer having a single input connected to said single output of said single transmission-control/priority-control circuit and two outputs, one of which is connected to other of said two inputs of said single transmission-control/priority-control circuit for sequentially supplying stored data into said other input of said single transmission-control/priority-control circuit every when new data are supplied from said single transmission-control/priority-control circuit so that said processes are continued sequentially until all data relating to all screens have been processed or said currently supplied data to be stored into said line, buffer have most significant priority for subsequent read out said stored data as real screen data from said line buffer.

* * * * *